US007914347B2

(12) United States Patent
Paulus

(10) Patent No.: US 7,914,347 B2
(45) Date of Patent: Mar. 29, 2011

(54) LOW RESISTANCE CONNECTOR FOR PRINTED CIRCUIT BOARD

(75) Inventor: Eric James Paulus, Phoenix, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 36 days.

(21) Appl. No.: 12/433,302

(22) Filed: Apr. 30, 2009

(65) Prior Publication Data

US 2010/0279536 A1 Nov. 4, 2010

(51) Int. Cl.
*H01R 13/64* (2006.01)

(52) U.S. Cl. ..... 439/680

(58) Field of Classification Search ..... 439/92, 439/292, 351, 353, 578, 581, 680, 353.5
See application file for complete search history.

(56) References Cited

U.S. PATENT DOCUMENTS

| | | | | | |
|---|---|---|---|---|---|
| 3,546,658 | A | * | 12/1970 | Van Horssen et al. | 439/318 |
| 4,211,461 | A | * | 7/1980 | Wescott | 439/357 |
| 4,881,912 | A | | 11/1989 | Thommen et al. | 439/585 |
| 4,932,673 | A | * | 6/1990 | Domnikov et al. | 277/608 |
| 5,746,619 | A | | 5/1998 | Harting et al. | 439/352 |
| 5,954,708 | A | | 9/1999 | Lopez et al. | 604/533 |
| 5,993,239 | A | * | 11/1999 | Wright | 439/357 |
| 6,062,607 | A | | 5/2000 | Bartholomew | 285/93 |
| 6,361,348 | B1 | | 3/2002 | Hall et al. | 439/352 |
| D456,355 | S | * | 4/2002 | Togashi | D13/133 |
| 6,409,534 | B1 | | 6/2002 | Weisz-Margulescu | 439/367 |
| 6,450,829 | B1 | | 9/2002 | Weisz-Margulescu | 439/352 |
| 6,663,397 | B1 | | 12/2003 | Lin et al. | 439/63 |
| 6,793,528 | B2 | | 9/2004 | Lin et al. | 439/582 |
| 6,955,563 | B1 | | 10/2005 | Croan | 439/578 |
| 7,291,033 | B2 | | 11/2007 | Hu | 439/347 |
| 7,335,058 | B1 | | 2/2008 | Burris et al. | 439/578 |
| 7,396,249 | B2 | | 7/2008 | Kauffman | 439/349 |
| 2004/0157498 | A1 | * | 8/2004 | Hall et al. | 439/680 |
| 2007/0249236 | A1 | * | 10/2007 | Petak | 439/680 |
| 2008/0180853 | A1 | * | 7/2008 | Son et al. | 360/256.2 |

* cited by examiner

*Primary Examiner* — Briggitte R Hammond
*Assistant Examiner* — Larisa Z Tsukerman
(74) *Attorney, Agent, or Firm* — Matthew J. Mason

(57) ABSTRACT

An electrical connector has first and second connector bodies. The first connector body has an inclined surface and the second connector body has arms that correspond to the inclined surfaces. At the end of the inclined surfaces are generally flat portions forming a ledge that prevent the connector bodies from separating. To unmate the connector bodies, one connector body is rotated relative to the other, causing the arms to move from the generally flat portion to the outer surface of the second connector to allow them to be moved axially away from one another.

14 Claims, 8 Drawing Sheets

LOW RESISTANCE CONNECTOR FOR PRINTED CIRCUIT BOARD

BACKGROUND OF THE INVENTION

1. Field of the Invention

The present invention relates generally to low resistance connectors for printed circuit boards, and particularly to connectors that require lower resistance to unmate the connector from printed circuit boards and only when the unmating of the connector from the printed circuit board is desired.

2. Technical Background

Coaxial connectors are used to connect with electrical connectors on printed circuit boards (PCBs). The electrical connectors on the PCBs are soldered to metallic traces on the PCBs, which in turn are laminated to the board material. Typical electrical connections between the PCB connector and coaxial connectors are of the push-pull type. These connections are known to cause a delamination of the soldered connections and the metallic traces on the PCBs themselves when the connectors are unmated due to the typically higher resistance required to unmate them.

Prior coaxial connectors used on PCBs have attempted to solve this problem by making the connection between the coaxial cable and the electrical connector easier to unmate (easier to pull), but that allowed the coaxial cable to become unmated when it was not desired, causing an unwanted interruption of the electrical systems.

It would be desirable therefore to provide an electrical connector that can be used on PCBs that allows for easy unmating of the connector only at desired times.

SUMMARY OF THE INVENTION

Disclosed herein is an electrical connector for a printed circuit board that includes a main body having a forward portion and a rearward portion, a front end and a back end and an opening extending therebetween, the front end disposed on the forward portion and the back end disposed on the rearward portion; the forward portion having a generally circular cross section, the forward portion having at least one inclined surface extending from the front end to a middle portion of the forward portion, and at least one generally straight portion adjacent the inclined surface creating a ledge between the inclined surface and the straight portion.

In some embodiments, the electrical connector has two inclined surfaces, two generally straight portions and two ledges.

In some embodiments, there is a transition portion between the generally straight portion and the outer surface of the forward portion.

In another aspect, an electrical connector is disclosed for connecting a printed circuit board and a coaxial cable that includes a first connector body having a forward portion and a rearward portion, a front end and a back end and an opening extending therebetween, the front end disposed on the forward portion and the back end disposed on the rearward portion, the forward portion having a generally circular cross section, the forward portion having at least one inclined surface extending from the front end to a middle portion of the forward portion, and at least one generally straight portion adjacent the inclined surface creating a ledge between the inclined surface and the straight portion and a second connector body having an outer sleeve, the sleeve having a front end and a back end and an opening therebetween, the opening configured to receive at least a portion of the forward portion of the first connector body, the outer sleeve having a least one arm extending between the front end and a middle portion and configured to engage the inclined portion and ledge of the forward portion to prevent axial movement of the first and second connector bodies relative to one another when the first connector body is disposed in the second connector body opening.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
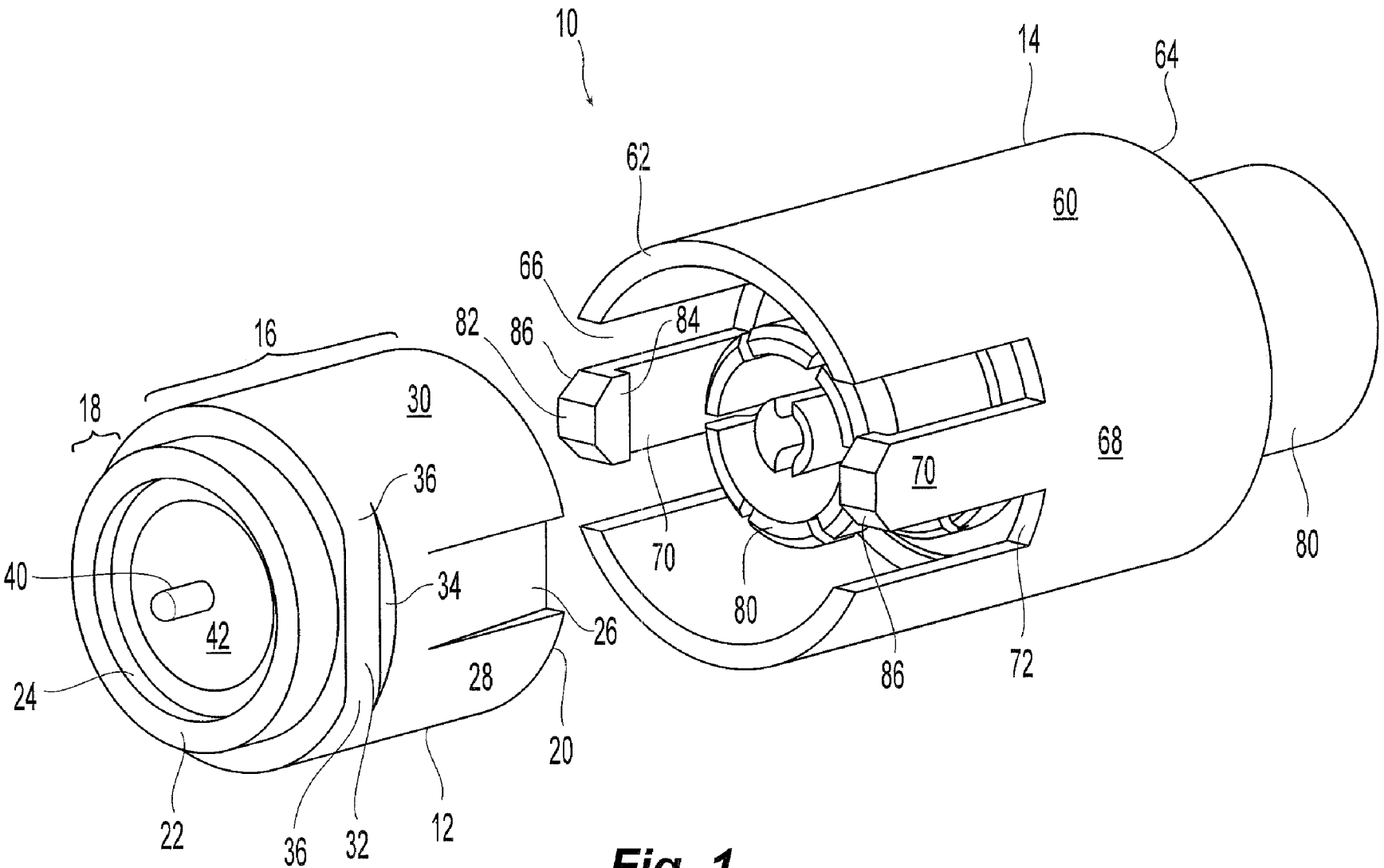
FIG. 1 is a perspective view of one embodiment of an electrical connector according to the present invention in an unmated position.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
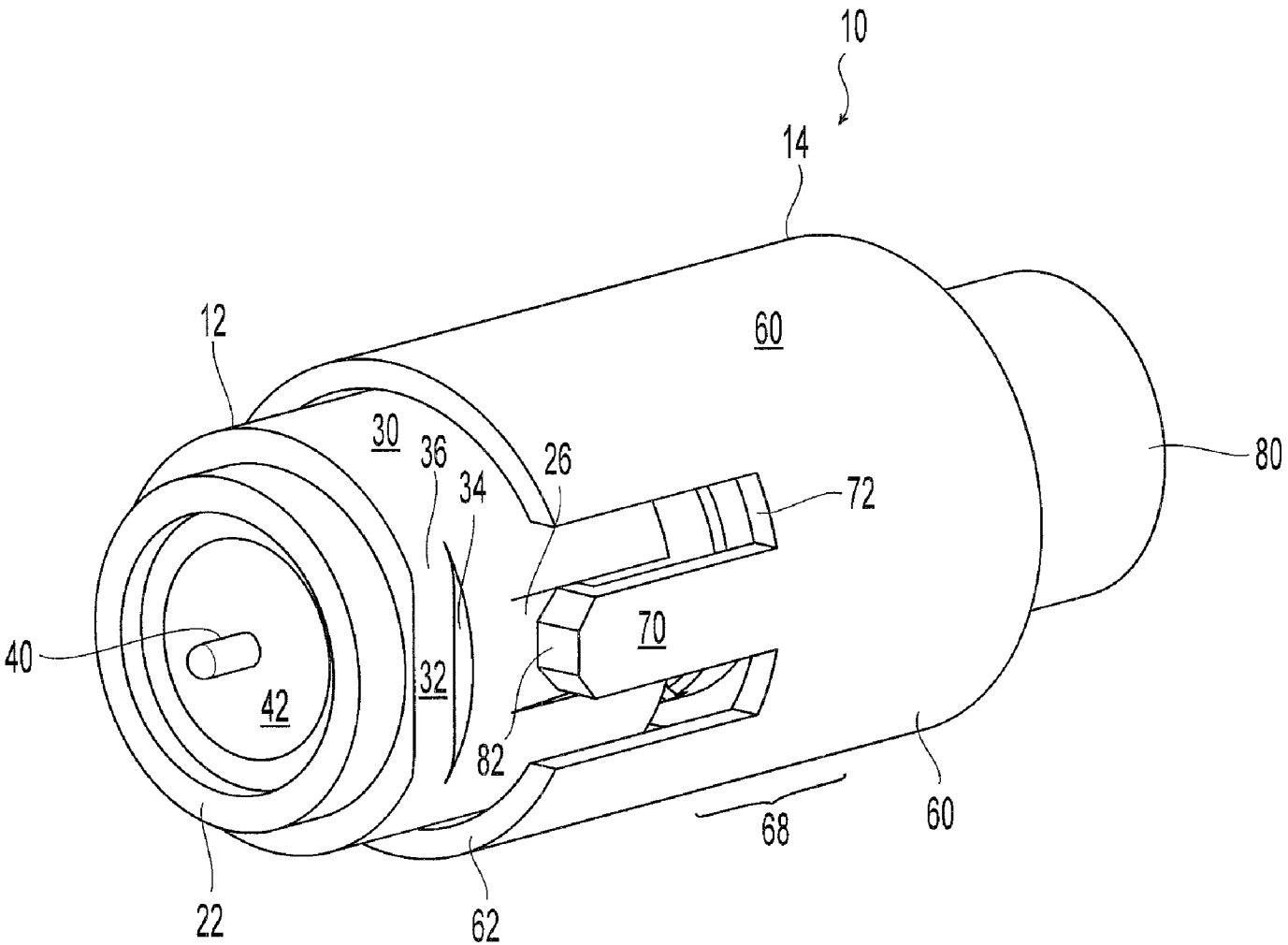
FIG. 2 is a perspective view of the electrical connector of FIG. 1 in a partially engaged position.

Referring to FIGS. 1 and 2, an electrical connector 10 has a first connector body 12 and a second connector body 14. The first connector body 12 has a forward portion 16 and a rearward portion 18. The forward portion 16 has a front end 20 and the rearward portion 18 has a back end 22, with an opening 24 extending therebetween. The forward portion 16 has a generally circular cross section with at least one inclined surface 26 extending from the front end 20 toward a middle portion 28 of the front portion 16. The inclined surface 26 inclines toward the outer surface 30 of first connector body 12 from the front end 20. The inclined surface 26 transitions into the outer surface 30, where there is a generally straight portion 32 that creates a ledge 34 between the generally straight portion 32 and outer surface 30, that in turn is adjacent the inclined surface 26. As illustrated in the figures, there are preferably two inclined surfaces 26, two generally straight portions 32, and two ledges 34. However, only one, or more, may be present and still come within the scope of the invention.

The generally straight portion 32 transitions into the outer surface 30 of the first connector body 12 at transition portions 36 at either end of the generally straight portion 32. The transition portions 36 have a radius that is preferably different from the diameter of the outer surface 30 of the first connector body 12. Preferably, the radius of the transition portion 36 is about 0.025 inches, but could range anywhere from 0.00 inches to 0.050 inches. The radius of the transition portion 36 is important for the operation of the electrical connector 10, as described in more detail below. It should also be noted that the radius and range of the radius can vary with size of the connector.

Figure 3:
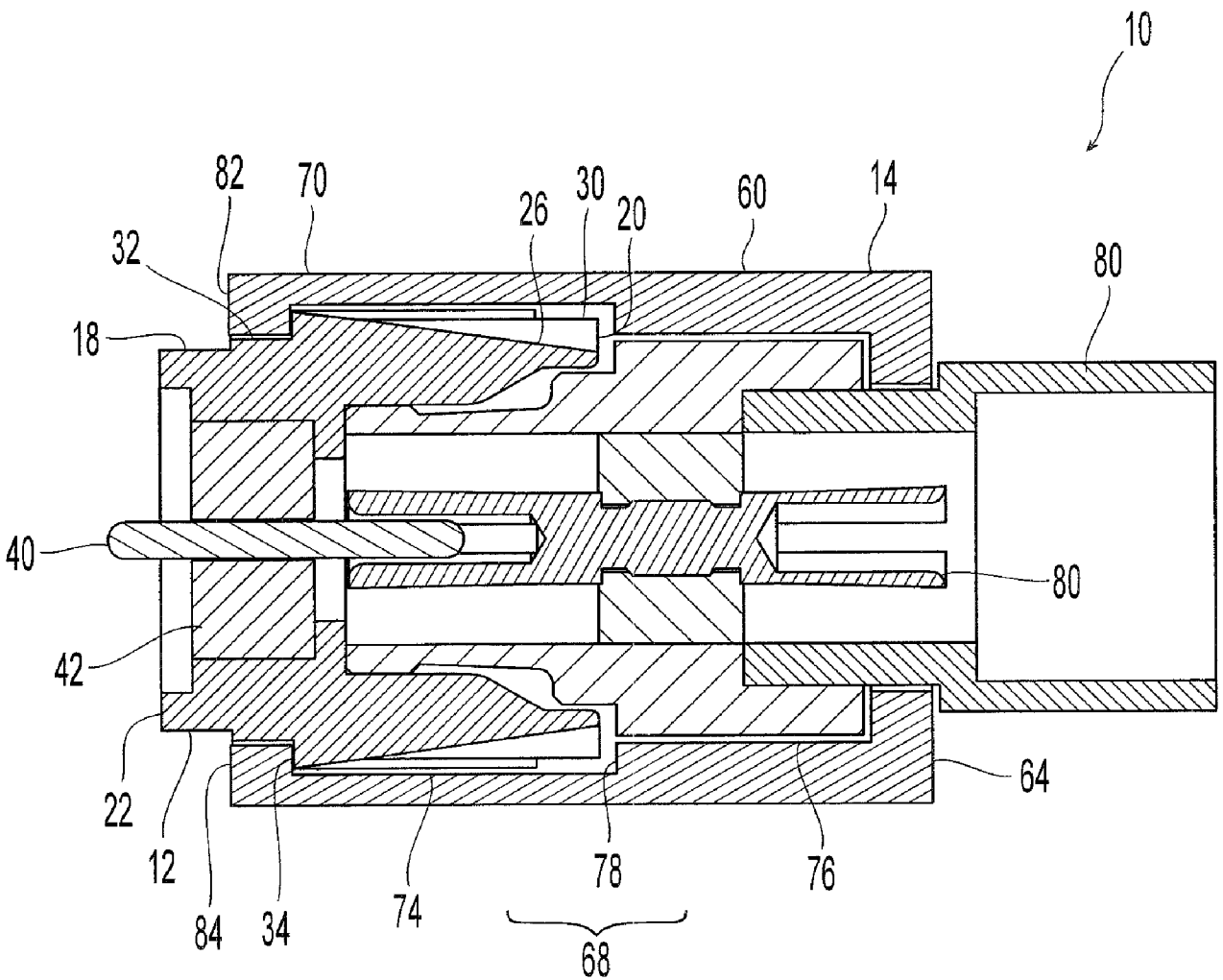
FIG. 3 is a cross sectional view of the electrical connector of FIG. 1 in a fully engaged position.
Figure 8:
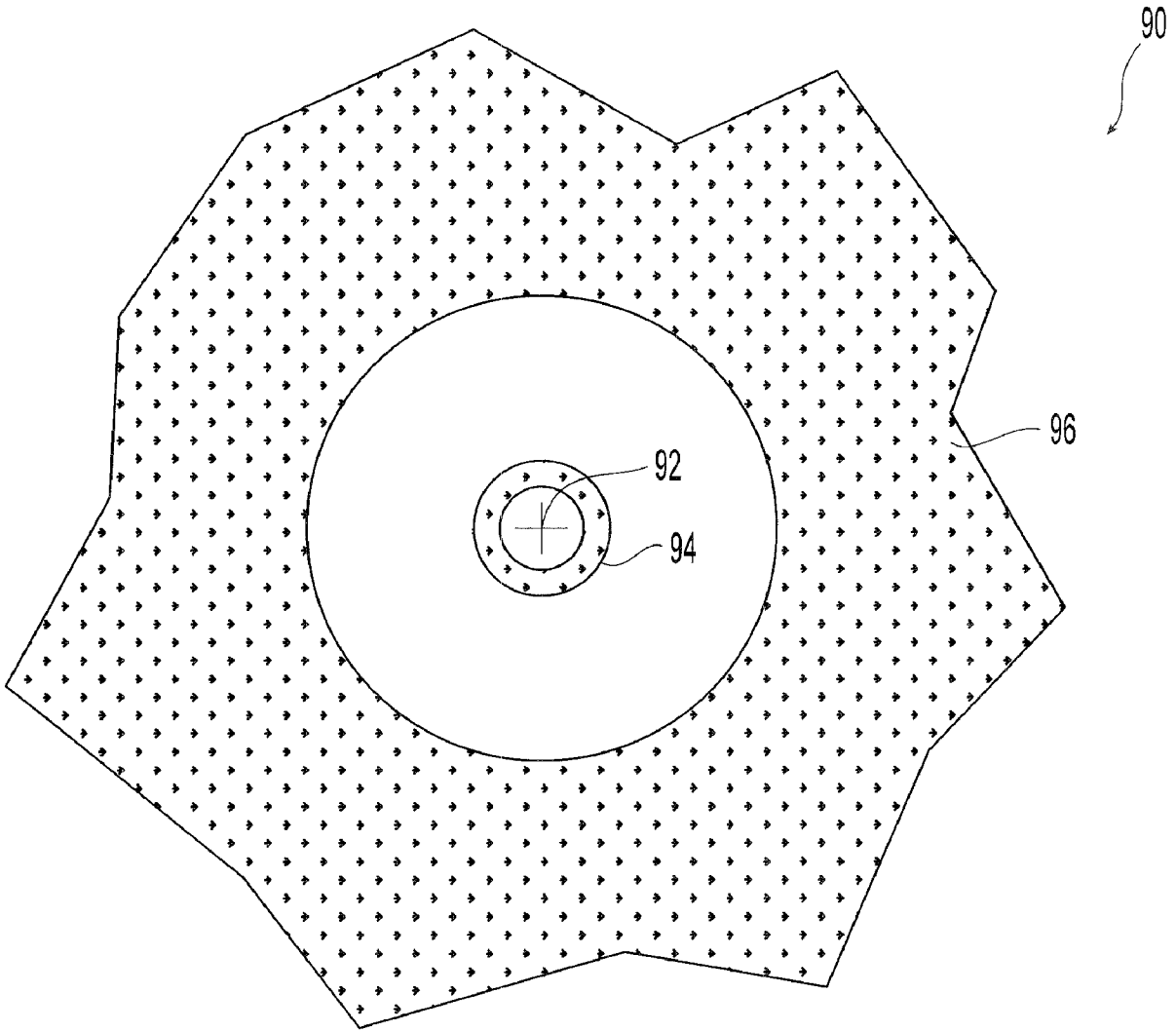
FIG. 8 is a schematic of a PCB board that can be used with the electrical connector.

The rearward portion 18 of first connector body 12 also has a generally circular cross section and has a diameter that is generally smaller than that of the forward portion 16. However the diameter of rearward portion 18 may also be the same as or larger than the radius of the forward portion 16. As is best illustrated in FIG. 3, the first connector body 12 may also have a center contact 40 and a dielectric member 42 to hold and center the center contact 40. The back end 22 of rearward portion 18 of the first connector body 12 and the center contact 40 are soldered to the PCB as is known in the art. For example as illustrated in FIG. 8, a PCB 90 is illustrated. The PCB 90 has an opening 92 into which the center contact 40 is soldered so that it makes contact with the signal metallization 94 and the back end 22 is soldered to the ground metallization 96. The metallizations 94, 96 are then electrically connected to metal traces.

The electrical connector 10 also includes the second connector body 14. Second connector body 14 has an outer sleeve 60 with a front end 62 and a back end 64 and an opening 66 extending therebetween. The outer sleeve 60 may be knurled or grooved to assist in gripping the second connector body 14. The second connector body 14 has a middle portion 68, where two cantilevered arms 70 extend toward the front end 62. The arms 70 are essentially a portion of the outer sleeve, as the arms 70 have the same outer diameter as the remainder of the outer sleeve 60 and are defined by two slots 72 extending from the front end 62 to the middle portion 68. The opening 66 preferably has two portions, a front inner portion 74 and a rear inner portion 76. See FIG. 3. The front inner portion 74 has a first diameter that is larger than the second diameter of the rear inner portion 76, thereby creating a forward facing surface 78 in the middle portion 68. The rear inner portion 76 is configured to receive a cable adapter, center contact and dielectric 80. The cable adapter, center contact and dielectric 80 are standard parts, known to those of skill in the art. The second connector body 14 is attached to a cable (not shown) and the cable adapter in a standard way.

The arms 70 are, by their nature, flexible and are able to flex outward (away from the opening 66). The arms 70 preferably have at the front end 82 a downward extending projections 84 (and, in particular, rearward facing surfaces 88) that engage the ledge 34 of the first connector body 12. Preferably, the arms 70 also have a chamfered portion 86 on the front end 82 to assist in guiding the arms 70 onto the at least one inclined surface 26. As the forward portion 16 of first connector body portion 12 is inserted into the opening 66 of the second connector body 14, the arms 70 engage the inclined surface 26 (see FIG. 2) and are flexed outwardly. As the two connector bodies are moved relative to one another, the arms 70 are flexed further outward until the downward extending projections 84 go over the ledge 34 and make contact with the generally straight portion 32. The engagement of the downward extending projections 84 with the ledge 34 prevents the second connector body 14 from being pulled axially away from the first connector body 12.

Figure 4:
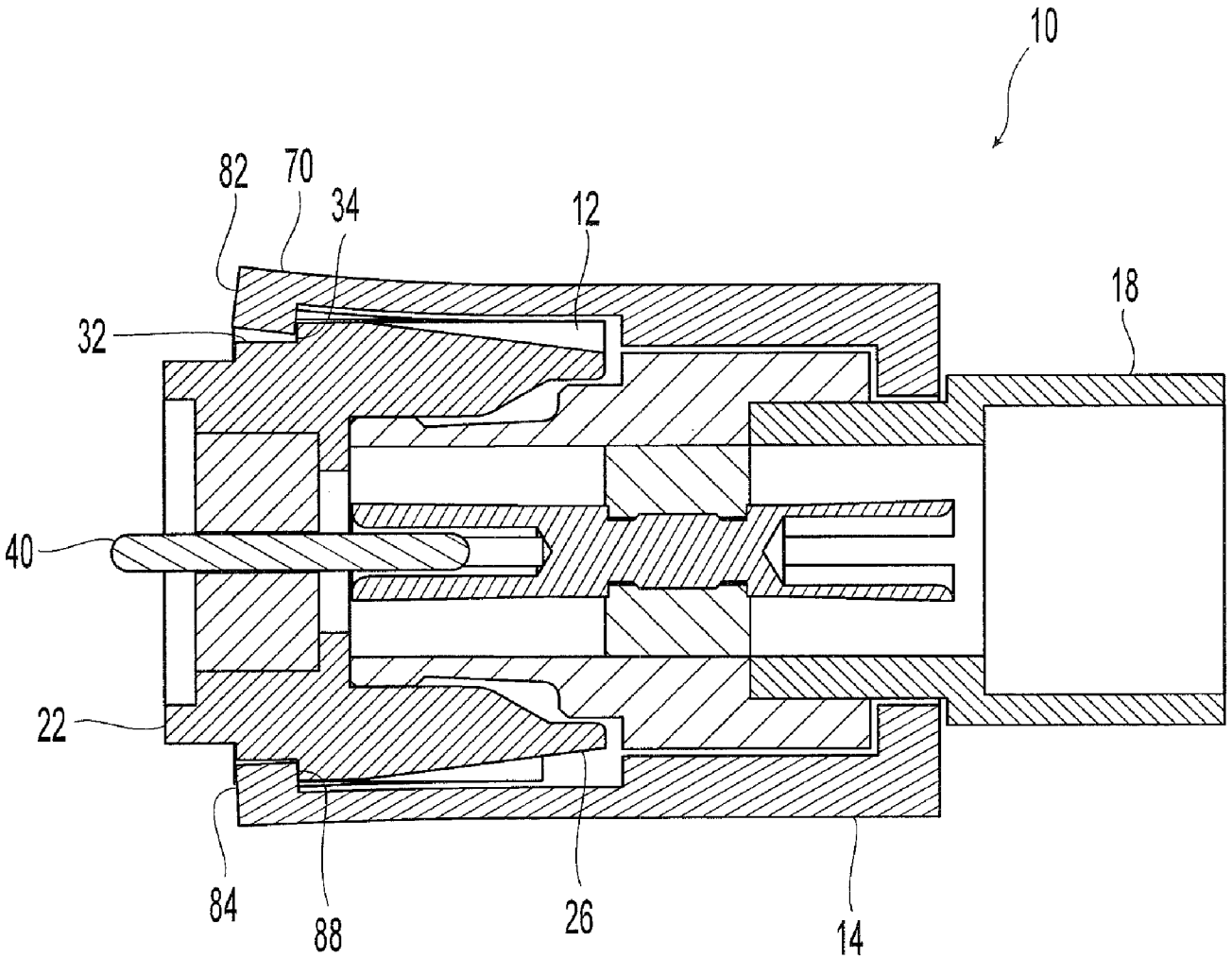
FIG. 4 is a cross sectional view of the electrical connector of FIG. 1 with the two bodies slightly rotated relative to one another.

With the ledge 34 and the rearward facing surfaces 88 of downward extending projections 84 engaging one another, the two connector bodies 12, 14 cannot be pulled apart and the force required to connect them to one another is very low. To unmate the first and second connector bodies 12, 14, the user must merely rotate the connector bodies 12, 14 relative to one another. As illustrated in FIG. 3, the two connector bodies 12, 14 are fully engaged. FIG. 4 illustrates that the two connector bodies 12, 14 have begun to be rotated relative to one another. As the arms 70 rotate and move along the generally straight portion 32, the arms 70 begin to flex outward. As the arms 70 approach the transition portions 36, the arms 70 flex outwardly even more. The larger the radius of the transition portions 36, the easier the arms 70 move from the generally straight portion 32 to the outer surface 30. When the arms 70 make contact with the outer surface 30 that has a constant radius (see FIG. 5), the second connector body 14 can be moved axially relative to the first connector body 12 and unmated with little force (generally limited to the friction of the downward extending projections 84 on the first connector body 12).

Figure 6:
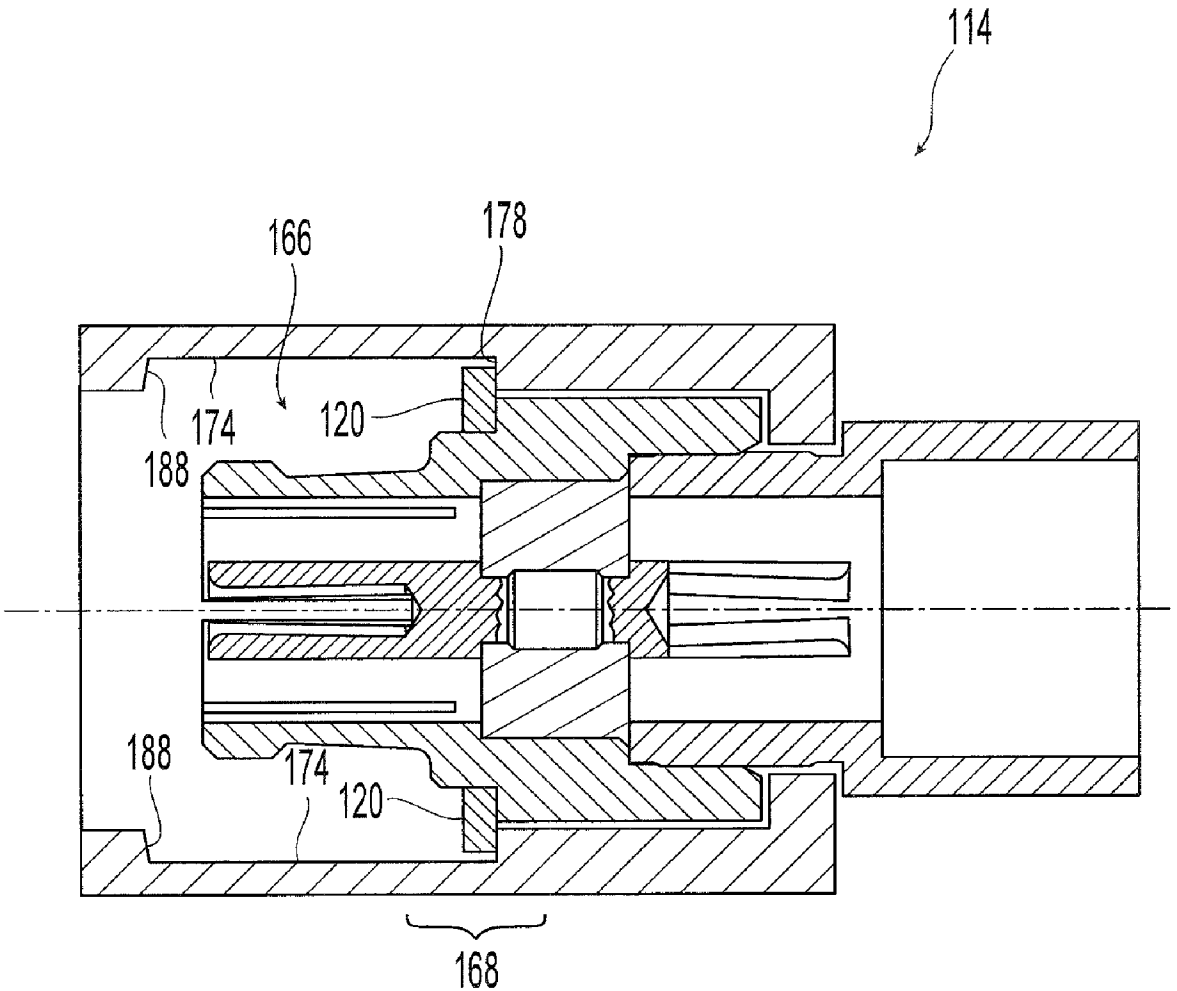
FIG. 6 is a cross sectional view of another embodiment of a second connector body of an electrical connector according to the present invention.

An alternative embodiment of a second connector body 114 is illustrated in FIG. 6. The second connector body 114 is similar to the second connector body 14 discussed above, but has an elastomeric gasket 120 that engages the forward facing surface 178 in the middle portion 168. The elastomeric gasket 120 is preferably impregnated with metallic particles to assist in preventing leakage of the electrical signal from the connector. The elastomeric gasket 120 allows the connector to be sealed against the elements when the first connector body is inserted into the opening 166 and the front end of the first connector body engages the elastomeric gasket 120 and compresses it against the forward facing surface 178.

Figure 5:
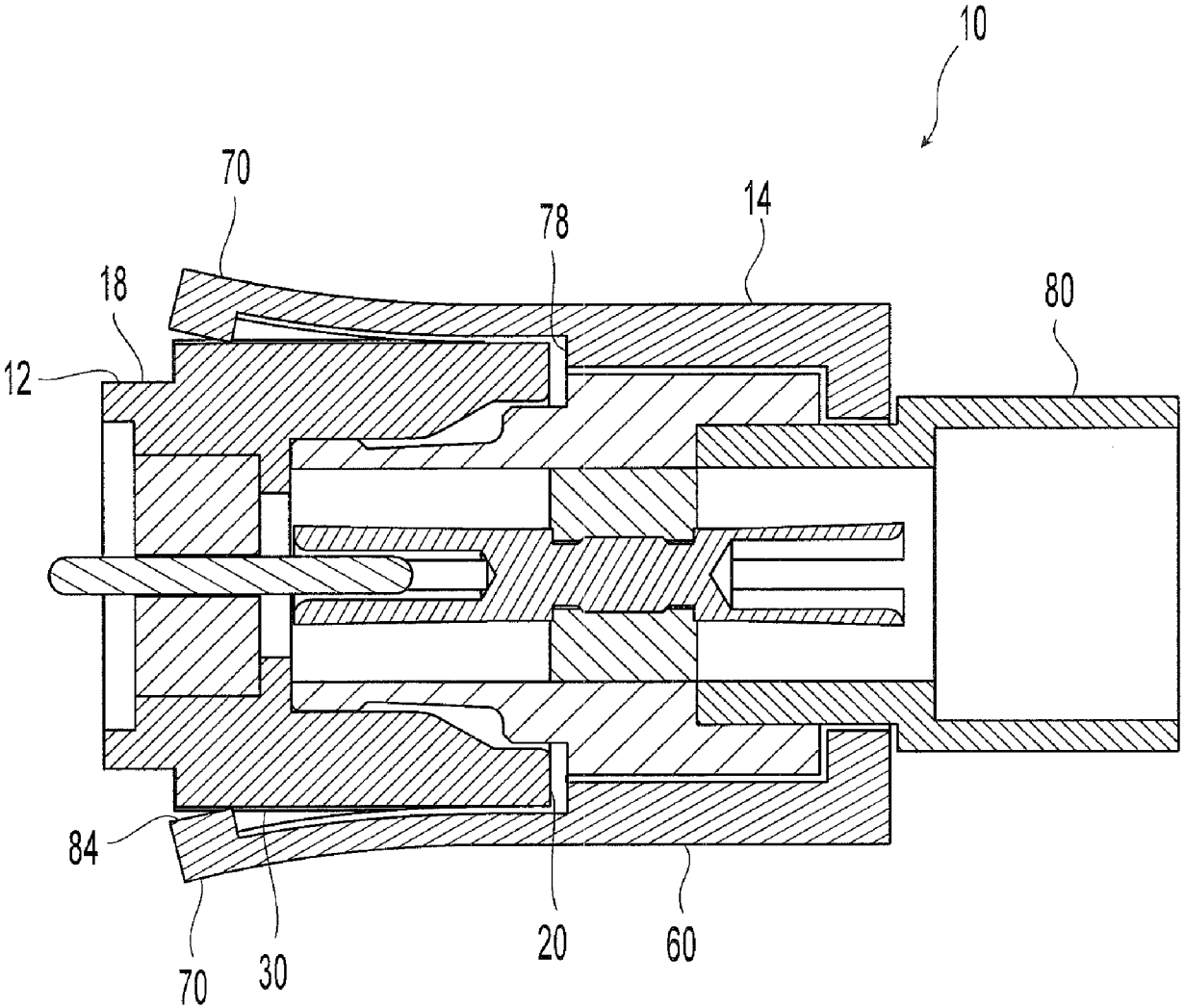
FIG. 5 is a cross sectional view of the electrical connector of FIG. 1 with the two bodies rotated relative to one another which allows the bodies to be separated with little force.

As illustrated in FIGS. 3-5 above, the ledge 34 and the rearward facing surfaces 88 of downward extending projections 84 of connector 10 are illustrated as being perpendicular to its axial axis. However, it is possible that the ledge 34 and the rearward facing surfaces 88 of downward extending projections 84 are slanted in a rearward direction to allow for easier engagement of the ledge 34 by the rearward facing surfaces of downward extending projections 84. For example, as illustrated in FIG. 6, rearward facing surfaces 188 of downward extending projections 184 have an angle other than 90 degrees with the front inner portion 174 (the ledge 34 would have a corresponding angle, but is not illustrated). Such a configuration compensates for any variations in the tolerances of the first and second connector bodies.

Figure 7:
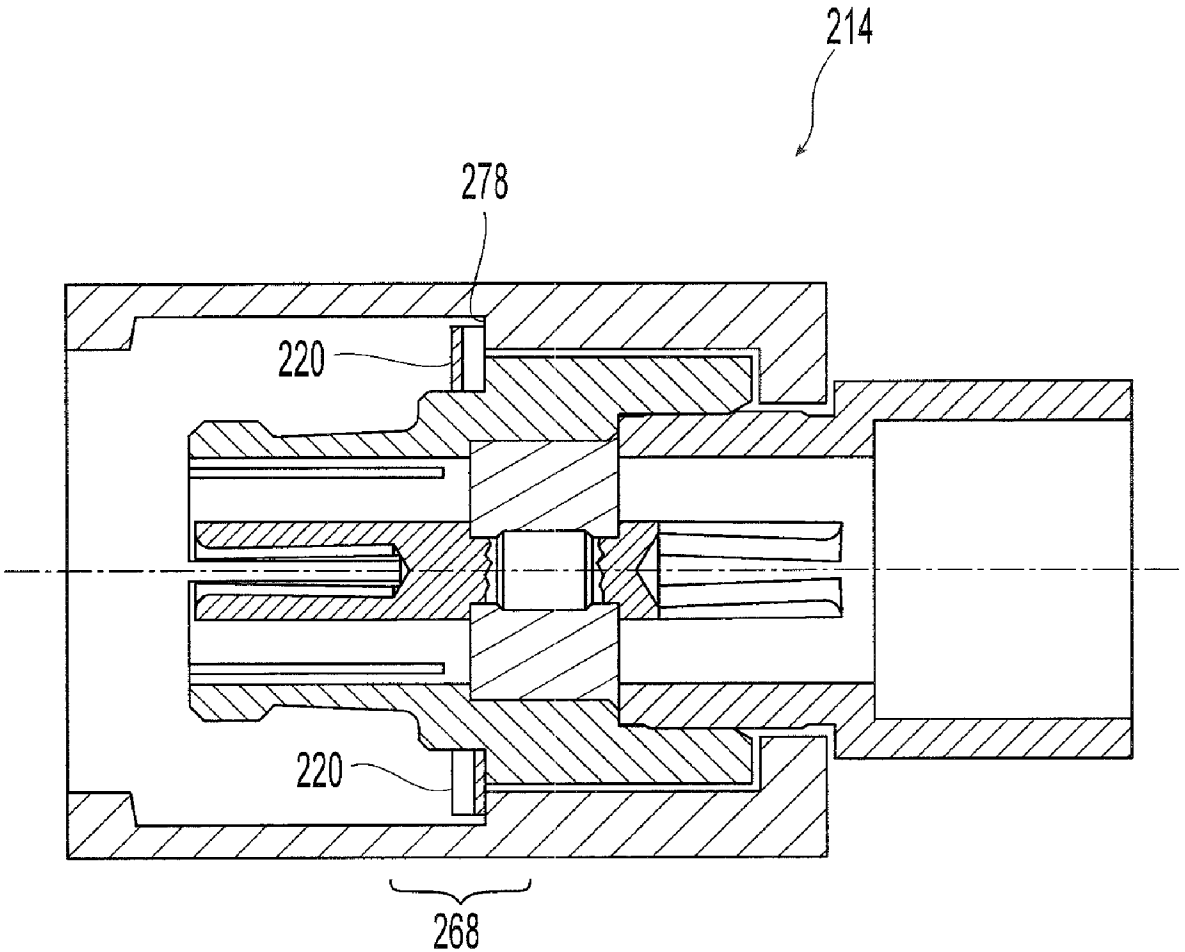
FIG. 7 is a cross sectional view of yet another embodiment of a second connector body of an electrical connector according to the present invention.

Another alternative embodiment of a second connector body 214 is illustrated in FIG. 7. The second connector body 214 has a wave spring washer 220 also disposed against the forward facing surface 278 in the middle portion 268, where it further limits the axial movement of the connector bodies relative to one another.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A connector for a printed circuit board comprising:

a main body having a forward portion having an outer surface, and a rearward portion, a front end and a back end and an opening extending therebetween, the front end disposed on the forward portion and the back end disposed on the rearward portion; the forward portion having a generally circular cross section;

the forward portion having at least one inclined surface extending from the front end to a middle portion of the forward portion, wherein the at least one inclined surface inclines toward and transitions into the outer surface between the front end and the middle portion of the forward portion; and at least one generally straight portion adjacent to where the inclined surface transitions into the outer surface, creating a ledge between where the inclined surface transitions into the outer surface and the straight portion.

2. The connector according to claim 1, wherein the at least one inclined surface includes two inclined surfaces, the two inclined surfaces being on opposite sides of the main body and the at least one generally straight portion includes two generally straight portions, one of the straight portions associated with a respective one of the two inclined surfaces.

3. The connector according to claim 1, wherein the forward portion has an outer surface having a first outer diameter and the rearward portion has an outer surface having a second diameter, the first diameter being different from the second diameter.

4. The connector according to claim 1, further comprising a transition portion between the at least one generally straight portion and an outer surface of the forward portion, the transition portion having a predetermined radius.

5. The connector according to claim 1, wherein the rearward portion is electrically connectable to printed circuit board trace connections.

6. The connector according to claim 1, wherein the opening is configured to receive a female cable connector.

7. An electrical connector for connecting a printed circuit board and a coaxial cable comprising:

a first connector body having a forward portion having an outer surface and a rearward portion, a front end and a back end and an opening extending therebetween, the front end disposed on the forward portion and the back end disposed on the rearward portion, the forward portion having a generally circular cross section, the forward portion having at least one inclined surface extending from the front end to a middle portion of the forward portion, wherein the at least one inclined surface inclines toward and transitions into the outer surface between the front end and the middle portion of the forward portion, and at least one generally straight portion adjacent to where the inclined surface transitions into the outer surface, creating a ledge between where the inclined surface transitions into the outer surface and the straight portion; and a second connector body having an outer sleeve, the sleeve having a front end and a back end and an opening therebetween, the opening configured to receive at least a portion of the forward portion of the first connector body, the outer sleeve having a least one arm extending between the front end and a middle portion and configured to engage the inclined portion and ledge of the forward portion to prevent axial movement of the first and second connector bodies relative to one another when the first connector body is disposed in the second connector body opening.

8. The electrical connector according to claim 7, wherein the at least one inclined surface comprises two inclined surfaces, the at least one generally straight portion comprises two generally straight portions adjacent respective ones of the two inclined surfaces, and the at least one arm comprises two arms.

9. The electrical connector according to claim 7, wherein rotating the second connector body relative to the first connector body moves the at least one arm from the at least one generally straight portion and ledge whereby the first and second connector bodies can be moved in an axial direction away from one another.

10. The electrical connector according to claim 7, wherein the second connector body has a forward facing surface extending at least partially about the opening and disposed between the front end and the back end and engages the front end of the first connector body when the first connector body is fully inserted into the second connector body.

11. The electrical connector according to claim 7, wherein the first connector body includes a recessed portion circumferentially about the front end and an elastic member disposed therein.

12. The electrical connector according to claim 7, wherein the elastic member includes metallic particles to prevent signal leakage.

13. The electrical connector according to claim 7, wherein the arm includes a downward extending portion to engage the ledge.

14. The electrical connector according to claim 7, further comprising a spring wave washer disposed between the first connector body and the second connector body.

* * * * *